United States Patent [19]

Kugler

[11] 4,410,412

[45] Oct. 18, 1983

[54] CATHODE FOR AN ELECTROLYTIC CELL FOR PRODUCING ALUMINUM VIA THE FUSED SALT ELECTROLYTIC PROCESS

[75] Inventor: Tibor Kugler, Thayngen, Switzerland

[73] Assignee: Swiss Aluminium Ltd., Chippis, Switzerland

[21] Appl. No.: 317,189

[22] Filed: Nov. 2, 1981

[30] Foreign Application Priority Data

Nov. 26, 1980 [CH] Switzerland ..... 8737/80

[51] Int. Cl.[3] ..... C25C 7/00; C25C 3/06

[52] U.S. Cl. ..... 204/286; 204/67; 204/291; 420/522; 204/243 R

[58] Field of Search ..... 204/64 R, 67, 286, 291-293, 204/243 R, 2; 420/522

[56] References Cited

U.S. PATENT DOCUMENTS

| | | | |
|---|---|---|---|
| 3,168,394 | 2/1965 | Johnson | 75/68 A |
| 3,391,999 | 7/1968 | Cole et al. | 420/552 X |
| 3,416,917 | 12/1968 | Sorbo | 420/552 X |
| 4,071,420 | 1/1978 | Foster et al. | 204/67 |
| 4,187,155 | 2/1980 | De Nora et al. | 204/67 |
| 4,239,606 | 12/1980 | Dawles et al. | 204/67 |
| 4,243,502 | 1/1981 | Kugler | 204/243 R |
| 4,265,717 | 5/1981 | Wiltzius | 204/67 |

*Primary Examiner*—F. Edmundson

*Attorney, Agent, or Firm*—Bachman and LaPointe

[57] ABSTRACT

An exchangeable, wettable solid cathode for a fused salt electrolytic cell for the production of aluminum is made out of at least one aluminide of the groups IV A, V A or VI A of the periodic system of elements. A titanium aluminide of the $\gamma$-phase has been shown to be particularly favorable for this purpose.

10 Claims, 2 Drawing Figures

CATHODE FOR AN ELECTROLYTIC CELL FOR PRODUCING ALUMINUM VIA THE FUSED SALT ELECTROLYTIC PROCESS

BACKGROUND OF THE INVENTION

The present invention relates to an exchangeable, wettable solid cathode for an electrolytic cell for producing aluminum via the fused salt electrolytic process.

In the electrolytic production of aluminum from aluminum oxide, the latter is dissolved in a fluoride melt which is comprised, for the main part, of cryolite. The cathodically precipitated aluminum collects under the fluoride melt on the carbon floor of the cell, the surface of the aluminum itself forming the cathode. Dipping into the melt from above are anodes which are secured to an overhead anode beam and, in the conventional processes, are made of amorphous carbon. As a result of the electrolytic decomposition of the aluminum oxide, oxygen is formed at the carbon anodes. This oxygen combines with the carbon of the anodes to form $CO_2$ and CO.

The electrolytic process in general takes place in a temperature range of about 940°-970° C. During the course of the electrolytic process the electrolyte becomes depleted in aluminum oxide. At a lower concentration of about 1-2 wt.% aluminum oxide in the electrolyte the anode effect occurs, whereby there is a rise in voltage from, for example, 4-4.5 V to 30 V and higher. Then, at the latest, the crust of solidified electrolyte must be broken open and the concentration of aluminum oxide increased by adding more aluminum oxide (alumina).

In the fused salt electrolytic process for making aluminum it is known to employ wettable, solid cathodes. It has been proposed therefore to employ cathodes made of titanium diboride, titanium carbide, pyrolytic graphite, boron carbide and other substances, including mixtures of these substances which may have been sintered together.

Cathodes which are wet by aluminum offer decisive advantages over conventional cells with an interpolar spacing of ca. 6-5.5 cm. The metal precipitated out in the process flows readily as soon as a very thin layer forms on the surface of the cathode facing the anodes. It is possible, therefore, to conduct the precipitated, liquid aluminum away from the gap between the anode and the cathode into a sump situated outside that gap. Due to the fact that the layer of aluminum on the solid cathode is thin, no non-uniformly thick aluminum layer is formed there, which is in strong contrast to the conventional process, as a result of conventional and electromagnetic forces. Consequently the interpolar gap can be reduced without diminution of current density, that is, a much lower consumption of energy per unit metal produced is achieved.

The U.S. Pat. No. 4,243,502, which proposes solid cathodes in the form of exchangeable elements each with at least one connection for the supply of current, provides a considerable improvement over the wettable cathodes which are permanently anchored in the carbon floor of the cell. As the material for wettable cathodes based on hard metals such as, for example, borides, nitrides and carbides of titanium, chromium and hafnium are relatively expensive, the exchangeable solid body cathodes are partly replaced by another suitable material. According to the German, published patent application No. 30 24 172.6 the exchangeable elements are made out of two parts which are made of different materials, an upper part projecting down from the molten electrolyte into the precipitated aluminum, and a lower part situated wholly in the liquid aluminum. These parts are joined together rigidly by mechanical means and are resistant to thermal shock. The upper part, at least in the surface region, is made solely of material which is wet by aluminum. The lower part or its coating is made out of insulating material which is resistant towards liquid aluminum.

Further trials have shown that the high melting points of both types of material make it necessary to employ expensive high temperature technology in the manufacturing process. Consequently only simple and relatively small parts can be made without problem. Furthermore, the brittleness of the materials more than seldom leads to mechanical damage occurring to the exchangeable cathode elements.

It is therefore a principal object of the present invention to develop an exchangeable solid cathode which can be made using simple technology, exhibits a lower degree of brittleness and yet satisfies all the economic and technical requirements of the modern aluminum electrolytic reduction process.

SUMMARY OF THE INVENTION

The foregoing object is achieved by way of the present invention wherein the cathode is made of an aluminide of at least one metal selected from the group consisting of titanium, zirconium, hafnium, vanadium, niobium, tantalum, chromium, molybdenum, tungsten, and mixtures thereof without the need of a binder phase of metallic aluminum. The non-aluminum components of the aluminide belong then to the groups IV A, V A and/or VI A of the periodic table of the elements.

BRIEF DESCRIPTION OF THE DRAWINGS

The geometrical form of the aluminide cathodes are shown in the accompanying drawings wherein.

DETAILED DESCRIPTION

Figure 1:
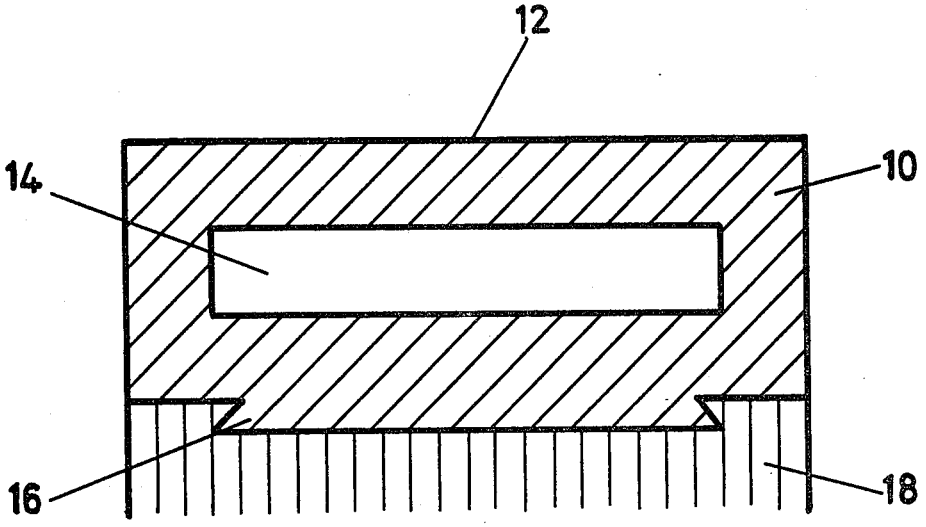
FIGS. 1 and 2 illustrate schematic vertical sections through aluminide cathodes which are joined by supporting plates.

The aluminides are in the form of individual binary compounds or as ternary, quaternary or quinternary alloys. Their ability to withstand chemical and thermal effects permit them to be used both in molten electrolytes and in molten aluminum, although they are to a limited extent soluble in the latter. This solubility however falls rapidly with decreasing temperature.

At the operating temperature of the cell, normally around 950° C., the solubility of a metallic non-aluminum component of the aluminide in liquid aluminum is of the order of approximately 1%. Cathode elements are therefore taken into solution until the precipitated liquid aluminum is saturated with one or more of the metallic, non-aluminum components.

The cathode elements made of an aluminide may have any desired shape. The elements can also be made up of sub-elements which are held together by some suitable means, especially in the form of vertical plates or rods. Because of the tendency of the aluminide cathode to go into solution these cannot be attached to the carbon floor such that they are not exchangeable. For economic and technical reasons the aluminide cathodes must be exchangeable. Aluminide cathodes cannot only be sintered but can also be cast. For this reason the cathode elements and the means of holding them can also be complicated in shape and/or made up in one piece. According to another version of the invention, the aluminide cathode elements can be situated in refractory holders made of an insulating material which is resistant to molten aluminum.

Furthermore, instead of cathode plates, aluminide balls and/or granules can be poured into the electrolytic cell and uniformly distributed by the moving currents in the bath. If desired balls or granules which come into contact only with the liquid metal can also be made out of an appropriate insulating material.

It is of great importance for all geometric forms of the cathode elements that the aluminide does not contain any binder made of metallic aluminum. At the operating temperature of the cell the metal binder would melt and the cathode elements would be destroyed within a short space of time.

The metals titanium, zirconium, hafnium, vanadium, niobium, tantalum, chromium, molybdenum and/or tungsten on the other hand can be alloyed with the aluminides in hyperstoichiometric ratios as their melting points are always above the temperature the aluminum reaches in the reduction process. These metals can also be employed as structural components in the aluminide, for example as a honeycomb structure around which the aluminide is cast or sintered.

The aluminides which dissolve during the electrolytic process are recovered from the precipitated metal and can be reused to manufacture cathode elements. As a result there is a closed circuit use of material in which there is relatively little loss of material.

For economic reasons and because they are scientifically well researched titanium aluminides are preferred for the exchangeable, wettable solid cathodes. In spite of the advanced level of knowledge here, in practice only titanium alloys containing a few percent aluminum or aluminum alloys with a few percent titanium are used. The $\gamma$-phase which in the Ti-Al-phase diagram lies between TiAl and $TiAl_3$ has been found to be a very good cathode material. The $\gamma$-phase containing 50–75 at.% aluminum (35–63 wt.%) is characterized by way of $TiAl_3$ needles embedded in a matrix of TiAl. An alloy richer in aluminum would, as mentioned previously, not only affect the stability of the solid cathode, but would have a negative effect on the operating conditions in the electrolytic cell.

From the phase diagram for Ti-Al alloys in the relevant technical literature it can be seen that the melting range of the $\gamma$-phase lies between 1340° and 1460° C. This relatively low melting range permits the aluminide cathode elements to be made by casting or using powder metallurgical methods.

At a cell working temperature of about 950° C. the solubility of titanium in liquid aluminum is around 1.2%. The aluminum precipitated onto the cathode elements will therefore dissolve some of the titanium aluminide until the concentration of titanium reaches 1.2%. This means that for each ton of aluminum produced in the cell approximately 30 kg of the solid cathode material will be dissolved. With a $TiAl_3$ cathode therefore there will be a consumption of 11.15 kg titanium per ton of aluminum produced. If the cathode plates are mounted parallel to the bottom face of the carbon anode, then in practice the titanium aluminide will be dissolved down to approximately 50% of the original thickness.

On changing anodes 60 kg of cathode elements are introduced into the cell, usefully forming a unit which dimensionally corresponds to the working surface of the anode. Before inserting the new cathode elements the rest, in the present case 30 kg, of the remaining cathode must be removed from the cell.

The removed remaining cathode is transported directly to the plant for manufacturing aluminide cathodes.

EXAMPLE 1

The aluminum, which is won by electrolysis and contains the normal impurities as well as 1.2% titanium, is placed in a holding furnace using conventional equipment. The temperature of the metal in this furnace is then lowered slowly to about 700° C. The density of the $TiAl_3$, which crystallizes out during this cooling, is 3.31 g/cm$^3$. As a result the $TiAl_3$ sinks in the lighter aluminum to the bottom of the furnace. Using known methods such as tilting the furnace, drawing off the metal by suction, or by means of centrifuging, the aluminum which still contains 0.2% titanium is separated from the material precipitated out. If necessary the aluminum can be treated with elemental boron, a boron-aluminum alloy or a boron compound such as, for example, potassium-boron-fluoride, as a result of which the titanium content of the aluminum can be lowered to 0.01 wt.% by precipitating out the titanium as titanium diboride.

The precipitated $TiAl_3$ produced on cooling the aluminum still contains small amounts of metallic aluminum which are removed by a suitable treatment, for example an acidic leachant. If a more titanium rich alloy is required than $TiAl_3$, aluminum can be removed by chlorination. The phase which can be used for the aluminide cathode extends to TiAl. The titanium aluminide produced is transported to the same plant for cathode manufacture as the above mentioned cathode rest. Examples of such plants are facilities for casting or powder metallurgy units which permit the desired shape of cathode to be produced.

The small, however unavoidable loss of titanium can be compensated by adding titanium dioxide to the electrolyte, to the alumina or to the caustic solution in the alumina plant.

EXAMPLE 2

Cathode elements for the aluminum electrolytic process can be made from other aluminide in a manner similar to that used to make titanium aluminide cathodes:

| Aluminide Cathode (at. % Al) | | Method of Manufacture | Melting point (°C.) |
|---|---|---|---|
| $ZrAl_2$—$ZrAl_3$ | (73.5) | Casting | 1490 Eut. |
| $VAl_3$—$V_5Al_8$ | (55) | Casting | 1600 |
| $Cr_4Al_3$—$Cr_5Al_8$ | (65) | Casting | 1650 |
| $MoAl_5$—$MoAl_{12}$ | (90) | Casting | 1650 |
| $WAl_4$—$WAl_5$ | (82) | Casting | 1400 |
| $ZrTiAl_5$ | (71) | Sintering (1100° C.) | ~1400 |

Figure 2:
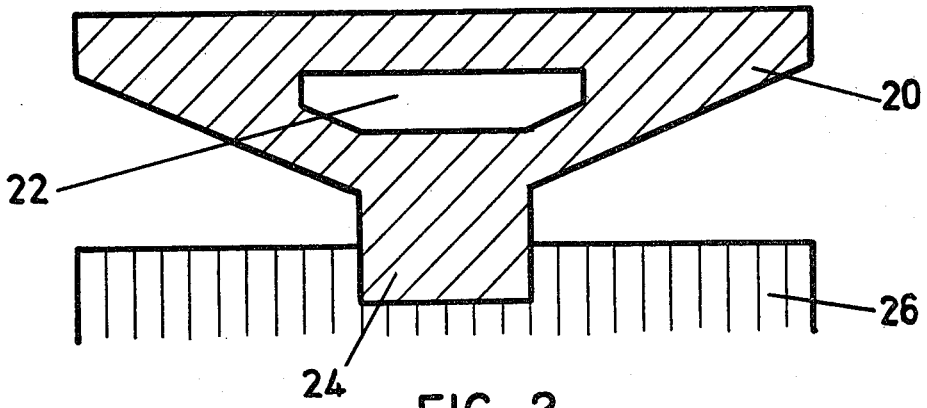

Examples of geometrical forms of versions of the aluminide cathode elements according to the invention are shown in the accompanying drawings. FIGS. 1 and 2 show schematic vertical sections through aluminide cathodes joined to supporting plates.

The cathode shown in FIG. 1 features an essentially rectangular aluminide cathode plate 10 with top surface 12 running parallel to the bottom face of the anode. The provision of a window 14 improves the flow of electrolyte in the cell. On the lower side the plate 10 features a dove tail 16 which can be introduced into a corresponding recess in the supporting plate 18 made of insulating material. This supporting plate 18 always remains in the liquid metal during operation of the cell. The means of fixing the supporting plates is such that the plates can not be displaced sideways.

A further version of aluminide plates 20 is shown in FIG. 2. Both the shape of the window 22 and the inclined lower faces are chosen first of all to economize on wettable material and secondly to optimize the conditions of electrolyte flow in the cell. A central, downwards pointing projection 24 secures the plate 20 in a supporting plate 26.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An exchangeable, wettable, consumable solid cathode for use in a fused salt electrolytic cell for producing aluminum, wherein said cathode is made substantially entirely of an aluminide of at least one metal selected from the group consisting of titanium, zirconium, hafnium, vanadium, niobium, tantalum, chromium, molybdenum, tungsten and mixtures thereof without a binder of metallic aluminum such that the melting point of said consumable solid cathode is greater than the operating temperature of the electrolytic cell during aluminum production.

2. A cathode according to claim 1 wherein said cathode is made of $\gamma$-phase titanium aluminide which lies between TiAl and $TiAl_3$.

3. A cathode according to claim 1 wherein the component which is not aluminum is alloyed with the aluminides in a hyperstoichiometric ratio.

4. A cathode according to claim 1 wherein the cathode comprises individually exchangeable elements which have approximately the same horizontal dimensions as the working surface of the anode.

5. A cathode according to claim 1 wherein a plurality of elements are grouped together in holders to form the cathode.

6. A cathode according to claim 5 wherein holders are provided for said plurality of elements, said holders being made of an insulating material which is resistant to molten aluminum.

7. A cathode according to claim 5 wherein said plurality of elements are vertically arranged plates or rods.

8. A cathode according to claim 6 wherein said plurality of elements are mechanically and rigidly attached to said holders wherein said holders are situated fully in liquid aluminum.

9. A cathode according to claim 1 wherein the working surface of the cathode is parallel to that of the anode.

10. A cathode according to claim 1 wherein the cathode comprises aluminide balls and/or granules poured into the cell below the working surface of the anodes.

* * * * *